US006184192B1

(12) United States Patent
Klinkhammer

(10) Patent No.: US 6,184,192 B1
(45) **Date of Patent: *Feb. 6, 2001**

(54) CHLORINATED IN-TANK TOILET CLEANSING BLOCK

(75) Inventor: Michael E. Klinkhammer, Racine, WI (US)

(73) Assignee: S. C. Johnson & Son, Inc., Racine, WI (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/840,045

(22) Filed: Apr. 24, 1997

(51) Int. Cl.[7] ..... C11D 77/04
(52) U.S. Cl. ..... 510/191; 510/192
(58) Field of Search ..... 510/191, 192, 510/193, 381, 382

(56) References Cited

U.S. PATENT DOCUMENTS

| | | | |
|---|---|---|---|
| 2,578,270 | | 12/1951 | Strain . |
| 2,913,460 | | 11/1959 | Brown et al. . |
| 2,980,622 | | 4/1961 | Symes . |
| 3,281,370 | | 10/1966 | Peech et al. . |
| 3,474,037 | | 10/1969 | Goldsmith . |
| 3,530,071 | | 9/1970 | Moore . |
| 3,915,880 | | 10/1975 | Sepulveda . |
| 3,962,106 | | 6/1976 | Rubin et al. . |
| 4,033,894 | | 7/1977 | McLaughlin et al. . |
| 4,043,931 | * | 8/1977 | Jeffrey et al. ..... 252/93 |
| 4,269,723 | | 5/1981 | Barford et al. . |
| 4,409,117 | | 10/1983 | Holmberg et al. . |
| 4,460,490 | * | 7/1984 | Barford et al. ..... 252/92 |
| 4,681,696 | | 7/1987 | Bruegge et al. . |
| 4,722,802 | * | 2/1988 | Hutchings et al. ..... 252/174 |
| 4,738,728 | * | 4/1988 | Barford et al. ..... 134/34 |
| 4,772,414 | | 9/1988 | Marazec et al. . |
| 4,820,449 | | 4/1989 | Menke et al. . |
| 4,898,681 | | 2/1990 | Burton . |
| 5,075,025 | | 12/1991 | Wainberg et al. . |
| 5,188,755 | * | 2/1993 | Chang ..... 252/174 |
| 5,205,955 | | 4/1993 | Bunczk et al. . |
| 5,290,470 | | 3/1994 | Dutcher . |
| 5,308,531 | | 5/1994 | Urfer et al. . |
| 5,336,427 | | 8/1994 | Bunczk et al. . |
| 5,376,296 | | 12/1994 | Dutcher . |
| 5,380,458 | | 1/1995 | Douglass . |
| 5,449,473 | * | 9/1995 | Bunczk et al. ..... 252/104 |

FOREIGN PATENT DOCUMENTS

| | | |
|---|---|---|
| 0 462 643 B1 | 10/1994 | (EP) . |

* cited by examiner

*Primary Examiner*—Yogendra Gupta
*Assistant Examiner*—John M Petruncio

(57) ABSTRACT

Disclosed herein is a toilet cleansing block containing a chlorine releasing agent. A preferred block is formulated with a cellulose ether to prolong life, a dye, and a stabilizer to suppress adverse interactions between the chlorine releasing agent and the cellulose ether, as well as between the chlorine releasing agent and the dye.

5 Claims, No Drawings

CHLORINATED IN-TANK TOILET CLEANSING BLOCK

CROSS REFERENCES TO RELATED APPLICATIONS

Not applicable.

STATEMENT REGARDING FEDERALLY SPONSORED RESEARCH

Not applicable.

BACKGROUND OF THE INVENTION

The present invention relates to cleansing blocks suitable for immersion in toilet tanks. The blocks are formulated to inhibit formation of toilet rings and surface stains.

Various cleansing blocks for use in toilet tanks and other water reservoirs are known. Such cleansing blocks typically contain a surfactant for cleaning, and often fillers, binders, colorants, extrusion aids and perfumes. They are designed to slowly release these materials into the toilet basin each time the toilet is flushed.

One particularly desirable form of such cleansing blocks are those that release chlorine compounds into the water supply to help clean and disinfect the toilet basin. See e.g. U.S. Pat. No. 5,336,427. The disclosure of this patent, and of all other publications referred to herein, are incorporated by reference as if fully set forth herein. However, chlorinated cleansing blocks can have a relatively short usage life.

Creating longer life chlorinated cleansing blocks has been a significant challenge. Among other things, such cleansing blocks should not include materials which leave undesirable residues in the toilet bowl, which are environmentally unacceptable, which have unpleasant odors, or which have incompatibility with other components. For example, cellulose ether binders are known to prolong the life of some toilet cleansing blocks. See e.g. U.S. Pat. No. 4,269,723. However, they can be unstable in the presence of chlorine releasing compounds. Also, chlorine releasing agents can interfere with some dyes used in such blocks.

Thus, it can be seen that a need exists for an improved toilet chlorinated cleansing block.

BRIEF SUMMARY OF THE INVENTION

In one aspect, the invention provides a water reservoir cleanser (e.g., in block form) having 1%–40% of a chlorine releasing agent selected from the group consisting of chloroisocyanurates, hypochlorites, chlorosuccinimides, chloramine T (sodium para-toluene sulfochlorine), and chlorodimethyl hydantoins; 1% to 20% cellulose ether binder; and at least 10% of a surfactant (preferably an anionic surfactant). There is also at least 2% of a stabilizer selected from the group consisting of mineral oil, isobornyl acetate, $C_{12}$–$C_{20}$ linear alcohols, and fragrance oils that have a specific gravity of less than 1 and are chlorine stable.

Examples of fragrance oils of this type are pine oil, Quest Q-7940A (Quest International Fragrances USA Inc. —herbal/pine), IFF Cloriffic 630 (International Flavors And Fragrances Inc. —lemon/citrus), and Takasago AG 4761-BHT (Takasago International Corporation —apple). It is especially preferred that such fragrance oils have a specific gravity between 0.83 and 0.98 and be essentially insoluble in water. One especially preferred fragrance oil is Unipine 85, a pine oil from Bushe, Boake and Allen, Inc. This fragrance oil has the added advantage of facilitating extrusion of the blocks during manufacture.

A test which can be performed to determine if a fragrance is chlorine stable is as follows. A small amount of solid chlorine containing compound is placed into a beaker. A sufficient amount of fragrance is added to substantially coat all of the particulate. The sample is observed periodically over a 24 hour period. The fragrance is considered stable as long as (1) there is no observable chemical reaction (e.g., exothermic, combustion); (2) there is no detectable strong chlorine odor from the sample; (3) there is no discoloration of the sample; and (4) the fragrance's characteristic odor has not significantly changed.

To achieve long life a cellulose ether binder is included in the block. Preferred cellulose ether binders are hydrated cellulose materials such as hydroxy alkyl celluloses such as hydroxy ethyl cellulose, hydroxypropyl methyl cellulose, and hydroxy propyl cellulose. Examples of other cellulose ether binders are methyl cellulose, ethyl cellulose, sodium carboxymethyl cellulose, ethyl hydroxyethyl cellulose, and carboxymethyl cellulose. It is believed that the stabilizer reduces the hydrolyzing effect of the bleach on the cellulose ether binder.

For toilet cleaning blocks, anionic surfactants are especially preferred, such as sodium dodecyl benzene sulfonate and sodium lauryl sulfate. However, a wide variety of surfactants (anionic, nonionic, cationic, zwitterionic), are suitable for use in toilet cleansing blocks (see e.g. U.S. Pat. No. 5,336,427).

Preferred chlorine releasing agents are alkali metal and alkaline earth metal hypochlorites, and alkali metal dichloroisocyanurates.

Surprisingly, even though the block has a bleach, the block can also include dye. In this regard, I have found that the stabilizer also reduces the oxidizing effect of the bleach on the dye. The choice of the dye/coloring agent will largely depend on the color desired for the water into which the lavatory cleanser composition is to be dispensed and its tendency not to stain porcelain. A preferred coloring agent is Acid Blue 9. Other suitable dyes are described in U.S. Pat. No. 5,336,427.

The amount of coloring agent or dye to be dispensed into the water will depend on the color intensity desired and the cost of the dye. The absorbance of the coloring agent may be determined for laboratory purposes through the use of a visible spectrophotometer, such as a Perkin-Elmer Model 552 spectrophotometer.

The amount of coloring agent delivered in the toilet bowl should be sufficient to provide an absorbance in a 1 cm spectrophotometric cell of from about 0.02 absorbance units ("a.u.") to about 0.2 a.u. when measured at its wavelength maxima. This is because consumers typically believe that a colored cleansing product is no longer working when it has a color intensity below this range.

Also, a filler/density aid, and various other conventional additives such as borax or ascorbic acid can be included. For example, to achieve adequate density so that the block won't float, and to keep costs to the minimum, inert fillers/density aids are preferably added. Inert salts are preferred for this purpose such as water-soluble inorganic or organic salts (or mixtures of such salts). Examples include various alkali metal and/or alkaline earth metal sulfates, chlorides, borates, and citrates. Specific inert salts are sodium sulfate, sodium sulfonate, calcium sulfate, sodium chloride, potassium sulfate, sodium carbonate, lithium chloride, tripotassium phosphate, sodium borate, potassium fluoride, calcium chloride, magnesium chloride, sodium citrate, magnesium sulfate and sodium fluoride. The filler/density aid is typically present in an amount from about 0% to about 60%, preferably about 10% to about 40% by weight.

In another embodiment, the invention provides a method of cleaning a basin of a toilet. One immerses one of the above blocks in a water reservoir for a toilet basin, allows a portion of the block to dissolve in the toilet tank water, and then flushes the toilet.

The objects of the present invention therefore include providing a water reservoir cleaner of the above kind:

(a) that is effective in inhibiting toilet bowl stain formation;

(b) which maintains toilet basins in a clean condition for an extended period;

(c) which uses environmentally acceptable and inexpensive components; and (d) which compatibly uses a chlorine releasing agent for cleaning, a cellulose ether for extended life, and a dye for providing an easy way for a consumer to tell when a replacement is needed.

These and still other objects and advantages of the present invention (e.g., methods for using these blocks) will be apparent from the description which follows. The following description is merely of the preferred embodiments. Thus, the claims should be looked to in order to understand the full scope of the invention.

MODES FOR CARRYING OUT INVENTION

Cleansing blocks for use in a toilet tank are:

EXAMPLE I

Control —No Stabilizer

| Ingredient | Weight % |
|---|---|
| sodium (60% active) dichloroisocyanurate | 6% |
| hydroxy ethyl cellulose | 5% |
| sodium dodecyl benzene sulfonate (85% active) (Ufaryl DL-85) | 60% |
| sodium sulfate | 19% |
| borax 5M | 10% |

EXAMPLE II

Alcohol And Fragrance Oil

| Ingredient | Weight % |
|---|---|
| sodium (60% active) dichloroisocyanurate | 6% |
| Neodol 23 ($C_{12}/C_{13}$ linear primary alcohol) | 3.5% |
| hydroxy ethyl cellulose | 5% |
| borax | 10% |
| sodium dodecyl benzene sulfonate (85% active) (Ufaryl DL-85) | 60% |

-continued

| Ingredient | Weight % |
|---|---|
| sodium sulfate | 12% |
| other fragrance oil Quest 7940 | 3.5% |

EXAMPLE III

Alcohol

| Ingredient | Weight % |
|---|---|
| sodium (60% active) dichloroisocyanurate | 6% |
| Neodol 23 | 7% |
| hydroxy ethyl cellulose | 5% |
| borax 5M | 10% |
| sodium dodecyl benzene sulfonate (85% active) (Ufaryl DL-85) | 60% |
| sodium sulfate | 12% |

EXAMPLE IV

Fragrance Oil

| Ingredient | Weight % |
|---|---|
| sodium dichloroisocyanurate (60% active) | 6% |
| hydroxy ethyl cellulose | 5% |
| borax 5M | 10% |
| sodium dodecyl benzene sulfonate (85% active) (Ufaryl DL-85) | 60% |
| sodium sulfate | 12% |
| other fragrance oil Quest 7940-A | 7% |

EXAMPLE V

Pine Oil and Dye

| Ingredient | Weight % |
|---|---|
| sodium dichloroisocyanurate (60% active) | 6% |
| Acid Blue #9 dye | 8% |
| hydroxy ethyl cellulose | 5% |
| Unipine 85 (pine oil) | 10% |
| sodium dodecyl benzene sulfonate (85% active) (Ufaryl DL-85) | 60% |
| sodium sulfate | 11% |

EXAMPLE VI

High Chlorine Content

| Ingredient | Weight % |
|---|---|
| sodium dichloroisocyanurate (60% active) | 27% |
| hydroxy ethyl cellulose | 3% |
| Unipine 85 (pine oil) | 10% |
| sodium dodecyl benzene sulfonate (85% active) (Ufaryl DL-85) | 60% |

In other preferred formulations, total surfactant is preferably between 40 and 80%, total cellulose ether is preferably between 1 and 20% (even more preferably between 5 and 15%), and the chlorine releasing agent is preferably between 1 and 60% (even more preferably between 5 and 40%) of the block. Total stabilizer is preferably between 2 and 20% of the block, even more preferably between 4 and 12%. When a dye is used, it is preferably between 1 and 20% of the block (e.g. 10% of the block when Acid Blue #9 is used).

To make blocks of the present invention, we preferably first create a homogeneous blend using a mixer such as a ribbon blender. The blend is then fed into the barrel of a screw extruder and passed through the extruder to form a continuous extrudate which is then cut to the size block desired.

The pressure through the die can be about 500–1250 psi. The barrel of the extruder can be maintained at less than 35E C. (e.g., an ambient temperature) by means of cooling water circulated through an external barrel jacket. The die head may be heated to assure a smoother surface of the product extrudate.

The block in the continuous extrudate form begins to cure upon leaving the extruder, and hence can be cut into cleansing blocks of requisite size by conventional cutting means downstream of the die and before substantially complete curing. The "block" need not be rectangular. It may be a tablet, disk, brick, or other solid mass, with or without crevices, holes or the like, and need not be formed by extrusion (albeit extrusion is preferred). Thus, any solid form mass is intended to be a "block" for purposes of this patent.

To test the blocks of the present invention, we placed such blocks in a conventional Kohler 3.5 gallon toilet tank. We flushed the toilet periodically as per a protocol that represented the median consumer usage (10 flushes per day, no flushes between 11 PM and 8 AM, etc.). Periodically, we tested and inspected for whether any of the block remained in the toilet tank.

Results

As one example, using 50.1 g–50.3 g blocks made from the Examples I (Control) and IV, the life of the blocks were as follows: Example I - 7 days Example IV —35 days Thus, the stabilizer greatly increased the useful life of the chlorinated block.

Industrial Applicability

The invention is useful in maintaining the cleanliness of toilet bowls associated with toilet tanks. It should also have applicability in other water reservoir systems (e.g. tanks for urinals).

We claim:

1. A water reservoir cleaning block comprising:

1% to 6% by weight of chlorine releasing agent selected from the group consisting of chloroisocyanurates;

at least 2% by weight of stabilizer selected from the group consisting of pine oils;

a dye;

1% to 20% by weight cellulose ether binder; and at least 10% by weight of an anionic surfactant;

wherein the chlorine releasing agent, stabilizer, dye, binder, and surfactant are blended together.

2. The water reservoir cleaning block of claim 1 wherein: the surfactant is sodium dodecyl benzene sulfonate.

3. The water reservoir cleaning block of claim 1 wherein: the dye is Acid Blue #9.

4. The water reservoir cleaning block of claim 1 wherein: the cellulose ether binder is a hydroxy alkyl cellulose.

5. A method of cleaning a basin of a toilet, comprising the steps of: immersing a block of the claim 1 cleaner in a water reservoir for the toilet basin;

dissolving a portion of the block in water in a toilet tank; and flushing the toilet.

* * * * *